United States Patent [19]

Yamamuro et al.

[11] Patent Number: 4,990,959

[45] Date of Patent: Feb. 5, 1991

[54] ONE-COMPONENT DEVELOPING APPARATUS WITH IMPROVED TONER LAYER REGULATING MEMBER

[75] Inventors: Takashi Yamamuro; Kazuo Terao; Kiyoshi Shigehiro, all of Kanagawa, Japan

[73] Assignee: Fuji Xerox Co., Ltd., Tokyo, Japan

[21] Appl. No.: 382,494

[22] Filed: Jul. 21, 1989

[30] Foreign Application Priority Data

Jul. 29, 1988 [JP] Japan ..... 63-190043

[51] Int. Cl.[5] ..... G03G 15/06

[52] U.S. Cl. ..... 355/245; 118/657; 355/251

[58] Field of Search ..... 355/245, 251, 252, 259, 355/270, 299; 118/651, 653, 657, 658

[56] References Cited

U.S. PATENT DOCUMENTS

| | | | |
|---|---|---|---|
| 2,297,791 | 10/1942 | Ness . | |
| 2,895,847 | 7/1959 | Mayo . | |
| 3,372,675 | 3/1968 | Tressel . | |
| 3,426,730 | 2/1969 | Lawson et al. . | |
| 4,154,522 | 5/1979 | Ikesue | 355/299 X |
| 4,505,577 | 3/1985 | Koizumi | 355/299 X |
| 4,579,081 | 4/1986 | Kohyama | 118/651 |
| 4,662,311 | 5/1987 | Shoji et al. | 118/651 |
| 4,780,741 | 10/1988 | Wada | 118/653 X |

FOREIGN PATENT DOCUMENTS

| | | | |
|---|---|---|---|
| 54-51848 | 4/1979 | Japan . | |
| 58-146249 | 10/1983 | Japan . | |
| 60-53975 | 3/1985 | Japan . | |
| 0027772 | 2/1987 | Japan | 355/259 |
| 0094872 | 5/1987 | Japan | 355/259 |
| 0242975 | 10/1987 | Japan | 355/259 |

*Primary Examiner*—A. T. Grimley
*Assistant Examiner*—William J. Royer
*Attorney, Agent, or Firm*—Finnegan, Henderson, Farabow, Garrett, and Dunner

[57] ABSTRACT

A one-component developing apparatus includes a developer carrier disposed in opposition to an electrostatic latent image receiving member, and a toner amount restricting member pressed so as to be in contact with the developer carrier. Wherein the toner amount restricting member includes a support member nade of a plate spring having tensile strength not smaller than 15 kgf/mm$^2$ and yield strength not smaller than 10 kgf/mm$^2$, and a soft elastic member disposed on the support member at a portion thereof to be pressed into contact with the developer carrier, the soft elastic member being attached on the support member so as to project from a forward end of the support member, whereby a thin layer of developer is formed on the developer carrier by the toner amount restricting member and charged so that the thin layer of toner is made adhere on an electrostatic latent image to make the electrostatic latent image visible.

9 Claims, 6 Drawing Sheets

ONE-COMPONENT DEVELOPING APPARATUS WITH IMPROVED TONER LAYER REGULATING MEMBER

BACKGROUND OF THE INVENTION

Field of the Invention

The present invention relates to a one-component developing apparatus for developing an electrostatic latent image with one-component toner.

The method of electrophotography disclosed in U.S. Pat. No. 2,297,791 to Carlson has a feature that "a photosensitive body having a photoconductive insulating layer is charged uniformly so as to form an electrostatic latent image by exposing an image, and the electrostatic latent image is visualized, that is, developed with a material such as electroscopic powder, and then transferred and fixed onto paper." Well known methods for developing an electrostatic latent image are the cascade developing process, the magnetic brush developing process, and the liquid developing process.

Another important developing method is transfer development which uses a toner carrier, called a donor, disclosed in U.S. Pat. No. 2,895,847. The transfer development described in this patent includes the cases of (1) a toner layer not in contact with a photosensitive body where the toner flies the gap between the toner layer and the photosensitive body, (2) a toner layer which contacts a photosensitive body while rotating, and (3) a toner layer which contacts a photosensitive body so as to slip on a picture portion. The transfer development is also known as the touchdown developing method.

FIG. 10 is a schematic diagram of a conventional magnetic one-component developing apparatus, which shows the case where the deflection angle $\theta_b$ of a plate spring is negative when a toner amount restricting member is urged onto a developer carrier. FIGS. 11(*a*) and 11(*b*) are side and perspective views illustrating the pressed-contacting state between the toner amount restricting member and the developer carrier. FIG. 12 is a schematic diagram illustrating the case where the deflection angle $\theta_b$ of the plate spring is positive in the developing apparatus of FIG. 10.

In the drawings, a developing apparatus is disposed close to a position opposite to an electrostatic latent image receiving member constituted by a photoconductive drum 1 which can hold an electro-static latent image 2 thereon. The developing apparatus is constituted by a hopper 3 for storing one-component magnetic toner 4, a magnet roll 5 having a plurality of magnetic poles of different polarities formed alternately, a non-magnetic cylindrical sleeve or developer carrier 6 supported so as to be rotatable around the magnet roll 5, and a toner amount restricting member 7. The magnet roll 5 is supported in the developer carrier 6 so as not to rotate. The toner amount restricting member 7 is urged onto the developer carrier 6 so as to restrict the amount of magnetic toner adhering on the developer carrier 6. The developer carrier 6 and the toner amount restricting member 7 are disposed within the hopper 3, and the developer carrier 6 is disposed close to the photoconductive drum 1 in the developing area.

In such a developing apparatus, the one-component magnetic toner 4 stored in the hopper 3 is held on the surface of the developer carrier 6 by the magnetic force of the magnet roll 5. The amount of the toner adhering on the developer carrier 6 is controlled to be 0.5 to 2.0 mg/cm$^2$ by the toner amount restricting member 7 constituted by a plate spring 7*a* and a soft elastic member 7*b*. Then, by the revolution of the developer carrier 6, the toner on the developer carrier 6 is fed into a developing area in which the photoconductive drum 1 and the developer carrier 6 are opposite to each other. A DC-super-imposed AC voltage is being applied to the developer carrier 6 from an AC high voltage power supply 8 and a DC power supply 9, so that the electrostatic latent image 2 on the photoconductive drum 1 is developed with the magnetic toner in the developing area A. Examples of representative prior art references include Japanese Patent Unexamined Publication No. 54-51848, Japanese Utility Model Unexamined Publication No. 58-146249, U.S. Pat. Nos. 3,372,675 and 3,426,730.

On the other hand, FIG. 13 is a schematic diagram of a conventional one-component developing apparatus using non-magnetic toner showing the case where the deflection angle $\theta_b$ of a plate spring is negative when the toner amount restricting member is urged upon a developer carrier, and FIG. 14 is a schematic diagram illustrating the case where the deflection angle $\theta_b$ is positive in the one-component developing apparatus shown of FIG. 13 (reference is made to Japanese Patent Unexamined Publication No. 60-53975).

In this apparatus, a non-magnetic one-component developer 4 is stored in a hopper 3 so that the developer 4 is supplied to a developer carrier 10 by a feeding member 13 rotating in the direction the arrow at the same peripheral speed as that of the developer carrier 10. A toner amount restricting member 7 comprising a plate spring 7*a* and a soft elastic member 7*b* is provided in contact with the developer carrier 10 at predetermined pressure. The developer 4 supplied onto the developer carrier 10 is fed to the position of the toner amount restricting member 7 by the revolution of the developer carrier 10 so as to form a predetermined uniform thin layer of the developer 4. After being sufficiently charged, the uniform thin layer of developer 4 is fed to a position A opposite the electrostatic latent image receiving member 1. An AC voltage is applied to the developer carrier 10, so that the developer is caused to fly onto the electrostatic latent image receiving member 1 by an alternating electric field generated in the gap between the electrostatic latent image receiving member 1 and the developer carrier 10, so as to develop the electrostatic latent image.

In the foregoing one-component developing apparatus, in order to uniformly and stably obtain the amount of toner to be fed to the developing area A, that is, the amount of toner on the developer carrier 6 or 10, the pressure of the soft elastic member 7*b* of the toner amount restricting member 7 must be regulated to make the soft elastic member 7*b* be in uniform contact with the developer carrier 6 or 10 in the axial and circumferential directions.

In the conventional developing apparatus, however, there are problems as follows. For example, as shown in FIGS. 11(*a*) and 11(*b*), the toner amount restricting member 7 is provided with the soft elastic member 7*b* made of rubber material on the side thereof pressed against the developer carrier 6. However, since the soft elastic member 7*b* is cut down at the top end of the plate spring 7*a*, a very slight unevenness occurs in the pressure distribution in the axial and circumferential directions of the soft elastic member 7*b* to the developer carrier 6 so that the amount of toner formed on the developer carrier 6 becomes uneven. This happens even if the toner-layer restriction contributing factors of the parts constituting the developing apparatus (for example, the accuracy in the linearity and parallelism of the toner amount restricting member 7 relative to the developer carrier 6, the accuracy in way of support of the toner amount restricting member 7, the accuracy in unevenness of cramping the toner amount restricting member 7, and the like) are made severe.

If the contact-pressure of the toner amount restricting member 7 against the developer carrier 6 or 10 is set high enough to improve the unevenness of the pressure distribution, it becomes necessary to make the driving torque of the developer carrier 6 or 10 high, so that a high driving power is required. By the high driving power, deflection may be caused in the developer carrier 6 or 10, or the toner may be deteriorated by heat due to friction between the toner amount restricting member 7 and the developer carrier 6 or 10, so that it is impossible to maintain an even stable amount of toner adhering to the developer carrier 6 or 10 and thereby impossible to perform developing with high reliability.

SUMMARY OF THE INVENTION

It is therefore an object of the present invention to solve the foregoing problems in the prior art.

It is another object of the present invention to provide a one-component developing apparatus in which it is possible to obtain a uniform contact pressure between the toner amount restricting member and the developer carrier so that a stable toner layer can be formed on the developer carrier, and developing can be performed with high reliability.

In order to achieve the above objects, according to the present invention, the one-component developing apparatus comprises: a developer carrier disposed in opposition to an electrostatic latent image receiving member; a toner amount restricting member pressed so as to be in contact with the developer carrier, whereby a thin layer of developer is formed on the developer carrier by the toner amount restricting member and charged so that the thin layer of toner is made to adhere on the electrostatic latent image receiving member in order to make the electrostatic latent image visible; wherein the toner amount restricting member includes a support member made of a plate spring having tensile strength not smaller than 15 kgf/mm$^2$ and yield strength not smaller than 10 kgf/mm$^2$, and a soft elastic member disposed on the support member on the portion thereof to be pressed into contact with the developer carrier, the soft elastic member being attached on the support member so as to project from a forward end of the support member.

Preferably, the soft elastic member is projected from the forward end of the support member with a projecting length within a range of from 0.1 to 10.0 mm.

Preferably, the deflection angle $\theta_b$ of the plate spring when the toner amount restricting member is in contact with the developer carrier is set to a value within a range of $-20° \leqq \theta_b \leqq 90°$. According to the present invention, it is necessary that the support member of the toner amount restricting member has tensile strength not smaller than 15 kfg/mm$^2$ and yield strength not smaller than 10 kgf/mm$^2$. If the tensile strength is smaller than 15 kgf/mm$^2$ and the yield strength is smaller than 10 kgf/mm$^2$, the soft elastic member attached on the plate spring may easily generate undulation parallel to the axial direction of the sleeve of the developer carrier so that the toner layer cannot be formed uniformly.

As the soft elastic member, it is preferable to use a rubber material having surface energy not larger than 30 dyn/cm and hardness within a range of from 30° to 70°.

According to the present invention, in order to obtain the desired contact pressure between the toner amount restricting member and the developer carrier, the toner amount restricting member is constituted by a support member made of a plate spring having tensile strength not smaller than 15 kgf/mm$^2$ and yield strength not smaller than 10 kgf/mm$^2$, and a soft elastic member which is disposed on the portion the support member to be pressed into contact with the developer carrier and which is attached on the support member so as to project from the forward end of the support member. Accordingly, the contact pressure of the toner amount restricting member against the developer carrier can be greatly reduced, and even in the case where the toner amount restricting member is made to contact the developer carrier with low pressure the contact pressure the developer carrier can be uniform in the axial and circumferential directions so that a toner layer can be formed stably and uniformly.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

An embodiment of the present invention will be described with reference to the drawings.

Embodiment 1

Figure 1:
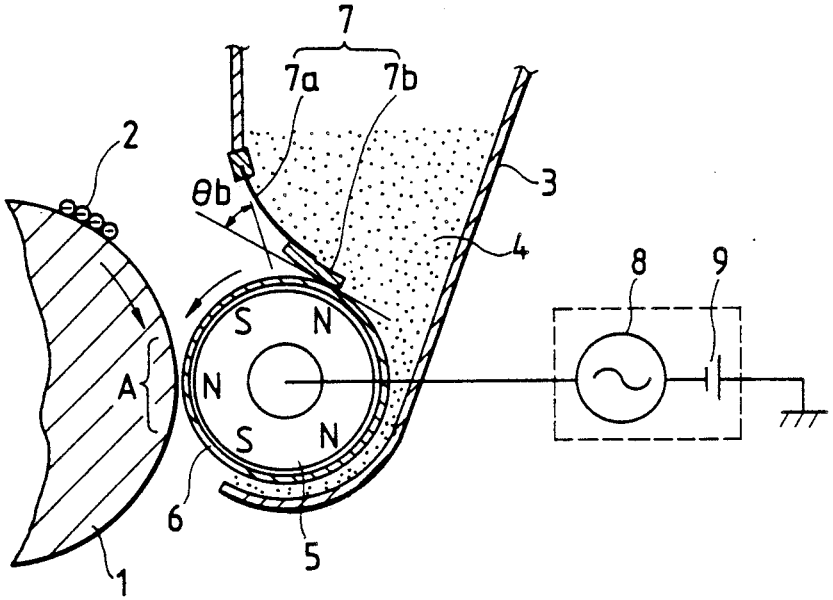
FIG. 1 is a schematic diagram of the magnetic one-component developing apparatus according to the present invention, showing the case where the deflection angle $\theta_b$ of the plate spring is negative when the toner restricting member is pressed into contact with the developer carrier.

FIG. 1 is a schematic diagram of the magnetic one-component developing apparatus according to the present invention, showing the case where the deflection angle $\theta_b$ of the plate spring is negative when the toner restricting member is pressed in contact with the developer carrier.

In FIG. 1, a photoconductive drum 1 or an electrostatic latent image receiving member has a surface composed of a negatively chargeable organic photosensitive material. After being charged uniformly by a charging means (not-shown), the whole surface of the photoconductive drum 1 is exposed. At this time, for example, the surface electric potential is −800 V, and the potential at its background portion is −120 V. One-component magnetic toner 4 containing 48% magnetic powder is stored in a hopper 3.

A magnet roll 5 having a magnetic pattern of N and S poles as shown in FIG. 1 is fixed to a frame (not-shown).

A developer carrier 6 constituted by a semiconductive resin sleeve which is formed through a process where phenol resin having a specific resistance value of $5\times10^9$ Ω·cm is formed into a cylindrical body having a thickness of 1.0 mm and the surface of the cylindrical body is ground in the longitudinal direction thereof so as to make the ten-point average roughness $R_2$ according to JIS (Japanese Industrial Standards) be Rz=4.3 μm. The sleeve 6 is supported so as to be rotatable around the magnet roll 5.

A toner amount restricting member 7 is constituted by a support member 7*a* and a soft elastic member 7*b*. The support member 7*a* is made of a plate spring of non-magnetic stainless steel SUS304CSP3/4H having a thickness in a range from 0.08 to 0.2 mm. The soft elastic member 7*b* is made of silicone rubber having a hardness within a range from 30° to 70°, and is vulcanized and stuck to a top end portion of the plate spring 7*a*. The soft elastic member 7*b* is shaped so as to have a thickness within a range of from 1 to 6 mm and a width within a range from 10 to 15 mm so that the contacting side of the forward end of the soft elastic member 7*b* projects by a projecting length *d* within a range from 0.5 to 8.0 mm from the forward end portion of the plate spring 7*a* as shown in FIGS. 2(*a*) and 2(*b*).

The thus configured toner amount restricting member 7 is urged by force within a range of 2 to 180 g/cm to contact the sleeve 6 at a position 90° to 180° behind a reference line (0°) extending through the developing position and the center of the magnet roll 5 so as to make the direction of the free end of the toner amount restricting member 7 opposite to the rotating direction of the sleeve, so that the deflection angle $\theta_b$ of the plate spring 7*a* is set to be within a range from −10° to 90°. Depending on the pressing/contacting force of the toner amount restricting member 7, the amount of adhering toner restricted by the toner amount restricting member 7 is in a range from 0.5 to 2.0 mg/cm$^2$.

The one-component developing apparatus thus configured was disposed in the copying machine so that the width of the gap between the sleeve 6 and the photoconductive drum 1 was 200 μm, and DC superimposed AC voltage having a frequency of 2.4 KHz, a peak-to-peak voltage of 2400 V and a DC-component of −200 V was applied to the semiconductive sleeve 6 from an AC power supply 8 and a DC power supply 9. Copies were produced under this condition, and very clear pictures could be obtained. Moreover, even if copies were taken continuously for a long time, no influence could be recognized upon the toner layer on the sleeve and clear pictures could be obtained.

Figure 10:
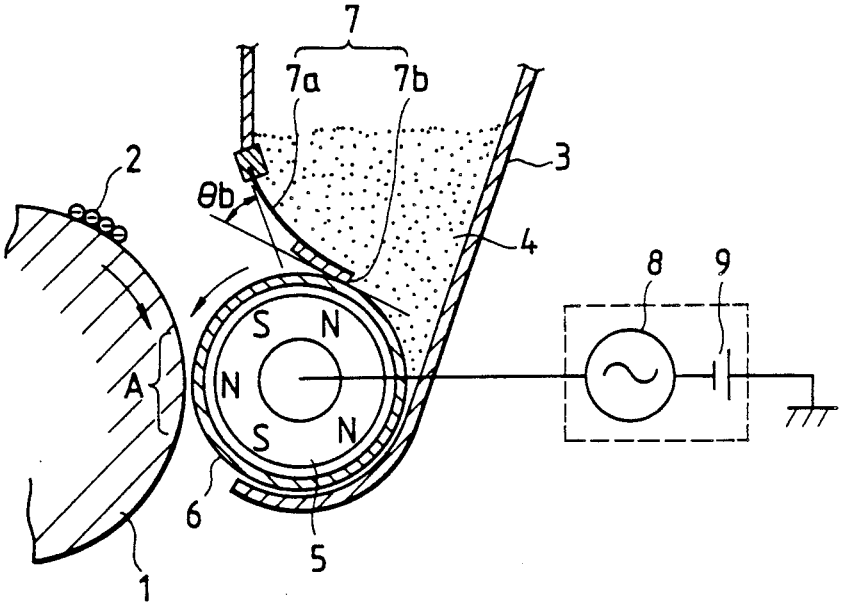
FIG. 10 PRIOR ART
FIG. 10 is a schematic diagram of a conventional magnetic one-component developing apparatus, which shows the case where the angle of deflection $\theta_b$ of a plate spring is negative when a toner amount restricting member is pressed to contact the developer carrier.
Figure 11A:
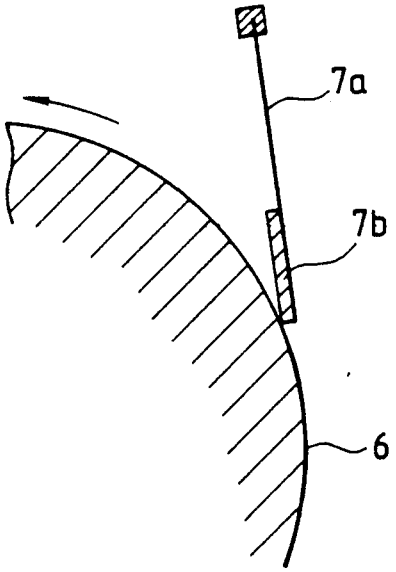
FIG. 11(a) PRIOR ART
FIGS. 11(*a*) and 11(*b*) are side and perspective views illustrating the toner amount restricting member pressed to contact the developer carrier in the developing apparatus shown in FIG. 10.
Figure 11B:
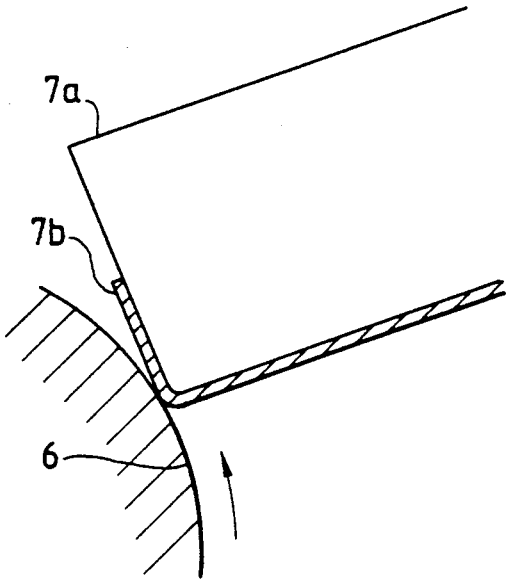
FIG. 11(b) PRIOR ART
Figure 12:
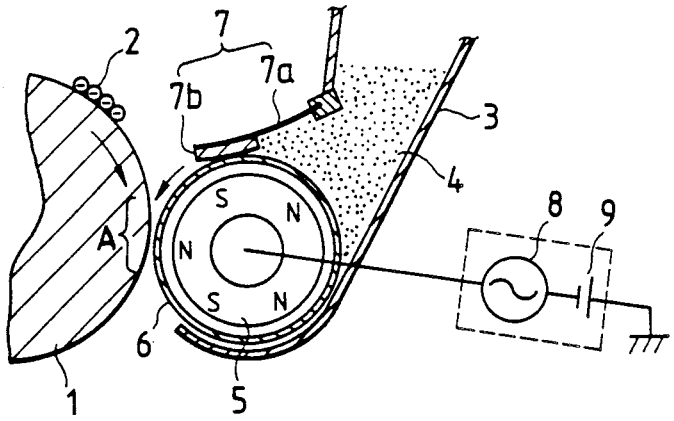
FIG. 12 PRIOR ART
FIG. 12 is a schematic diagram of a conventional magnetic one-component developing apparatus, showing the case where the deflection angle $\theta_b$ of the plate spring is positive when the toner amount restricting member is pressed to contact the developer carrier.

The effect of the developing apparatus according to the present invention will be described with reference to FIG. 7 in comparison with the conventional developing apparatus shown in FIG. 10.

Figure 7:
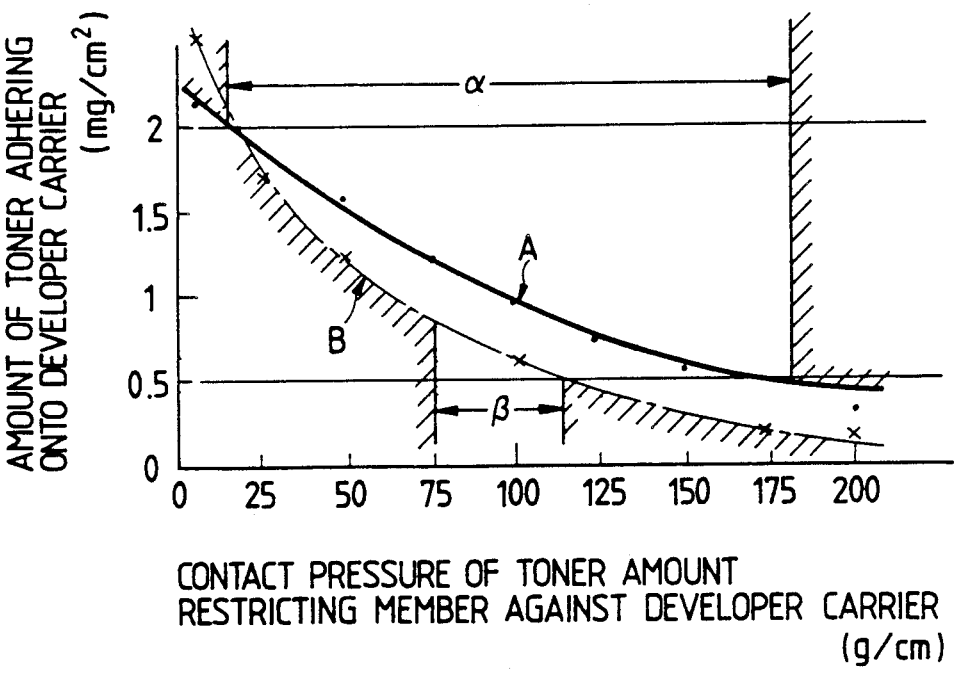
FIG. 7 is a diagram illustrating the relationship between the contact pressure of the toner amount restricting member against the developer carrier, and the amount of toner adhering onto the developer carrier in a conventional magnetic one-component developing apparatus and in the developing apparatus according to the present invention.

FIG. 7 is a diagram illustrating the relationship between the contact pressure of the toner amount restricting member to the developer carrier and the amount of adhering toner on the developer carrier. In FIG. 7, the line A shows the amount of adhering toner in the developing apparatus according to the present invention, and the line B shows the amount in the conventional developing apparatus shown in FIG. 10. The predetermined amount of adhering toner required for developing is within a range of from 0.5 to 2.0 mg/cm$^2$, and if the amount of adhering toner is more than this range, fog is generated in a background portion, while if it is less than the range, the picture becomes low in density. In the developing apparatus according to the present invention, it is possible to form a uniform and stable toner layer in the region o as shown in FIG. 7. In the conventional developing apparatus shown in FIG. 10, on the contrary, it is possible to form a uniform and stable toner layer merely in the region $\beta$, and in the region where the line pressure is higher than that in the region $\beta$, the amount of adhering toner becomes insufficient, while in the region where the line pressure is lower than that in the region $\beta$, the forward end portion of the soft elastic member is not uniformly pressed to come in contact in the axial and circumferential directions of the developer carrier to thereby cause fine variations in pressure distribution to make the toner layer uneven.

Thus, it has been confirmed that in the developing apparatus according to the present invention it is possible to form a uniform and stable toner layer on the developer carrier even if the toner amount restricting member is pressed to contact the developer carrier with low pressure.

Figure 3:
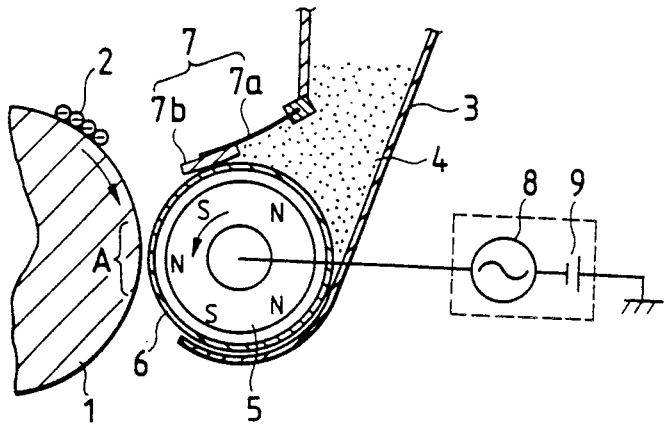
FIG. 3 is a schematic diagram of the magnetic one-component developing apparatus according to the present invention, showing the case where the deflection angle $\theta_b$ of the plate spring is positive when the toner amount restricting member is pressed into contact with the developer carrier.

FIG. 3 is a schematic diagram of the magnetic one-component developing apparatus according to the present invention for the case where the deflection angle $\theta_b$ of the plate spring is positive when the toner amount restricting member is pressed to come contact the developer carrier.

As shown in FIG. 3, the arrangement is such that the developer layer can be restricted by the surplus forward end portion (toner outflow portion) of the soft elastic member *7b* at its pressure-contacting side with the developer carrier 6 even if the forward end portion of the soft elastic member *7b* of the toner amount restricting member 7 is arranged in the same direction as the rotation of the developer carrier 6. Accordingly, it is possible to maintain a uniform developer layer for a long time, and it is therefore possible to obtain a stable and high-quality copy.

Embodiment 2

In the developing apparatus according to the present invention shown in FIG. 1, microcapsule toner was used as the toner 4. First, the non-conductive drum or electrostatic latent image receiving member having a surface composed of a negative-chargeable organic photosensitive material was charged uniformly over the whole surface thereof by a charging means (not-shown), and then the whole surface was exposed. At this time, for example, the surface electric potential was −800 V, and the potential at the background portion was −120 V. The microcapsule toner 4 stored in the hopper 3 contained 40% magnetic powder.

The magnet roll 5 and the sleeve 6 were the same as those in Embodiment 1.

Figure 2A:
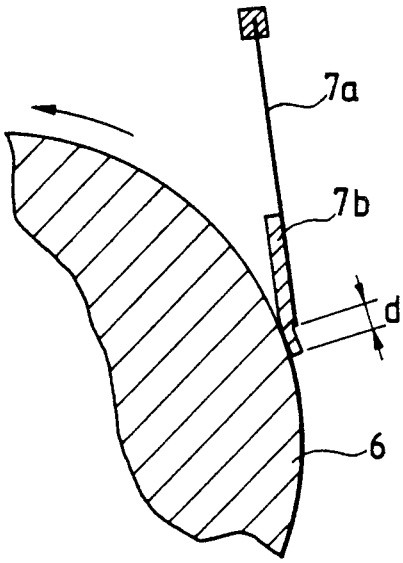
FIGS. 2(*a*) and 2(*b*) are side and perspective views illustrating the shape of the soft elastic member according to the present invention.
Figure 2B:
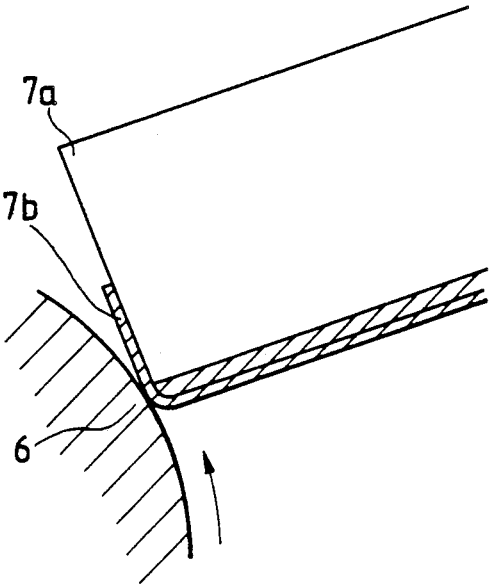

In the toner amount restricting member 7, a non-magnetic stainless-steel material SUS304CSP3/4H having a thickness of 0.1 mm was used as the support *7a* and silicone rubber of rubber hardness 50°, was vulcanized and stuck to the forward end portion of the support *7a* as the soft elastic member *7b*. The silicone rubber had, as shown in FIGS. 2(a) and 2(b), a shape having a thickness of 1 mm and a width of 15 mm, and the pressure-contacting side forward end portion thereof had a projecting length d of 2.0 mm and projected out from the end portion of the plate spring *7a*.

This toner amount restricting member 7 was urged by force of 5 g/cm to come into contact with the sleeve 6 at a position 165° behind a reference line (0°) extending through the developing position and the center of the magnet roll 5 so as to make the direction of the free end of the toner amount restricting member 7 opposite to the rotating direction of the sleeve, so that the deflection angle $\theta_b$ of the plate spring *7a* was set to −2° C. The amount of adhering toner restricted by the toner amount restricting member 7 was 0.6 mg/cm$^2$ on the sleeve 6.

The one-component developing apparatus thus configured was disposed in a copying machine so that the width of gap between the sleeve 6 and the photoconductive drum 1 was 200$\mu$, and DC-superposed AC voltage having a frequency of 2.4 KHz, a peak-to-peak voltage of 2400 V and a DC-component of −200 V was applied to the semiconductive sleeve 6 from an AC power supply 8 and a DC power supply 9. Copies were produced under this condition, and very clear pictures could be obtained. Moreover, even if copies were taken continuously for a long time, no influence could be recognized upon the toner layer on the sleeve and clear pictures could be obtained.

The effect obtained in the case where microcapsule toner is used as the toner in the developing apparatus according to the present invention will be described with reference to FIG. 8 in comparison with the case in the conventional developing apparatus shown in FIG. 10.

Figure 8:
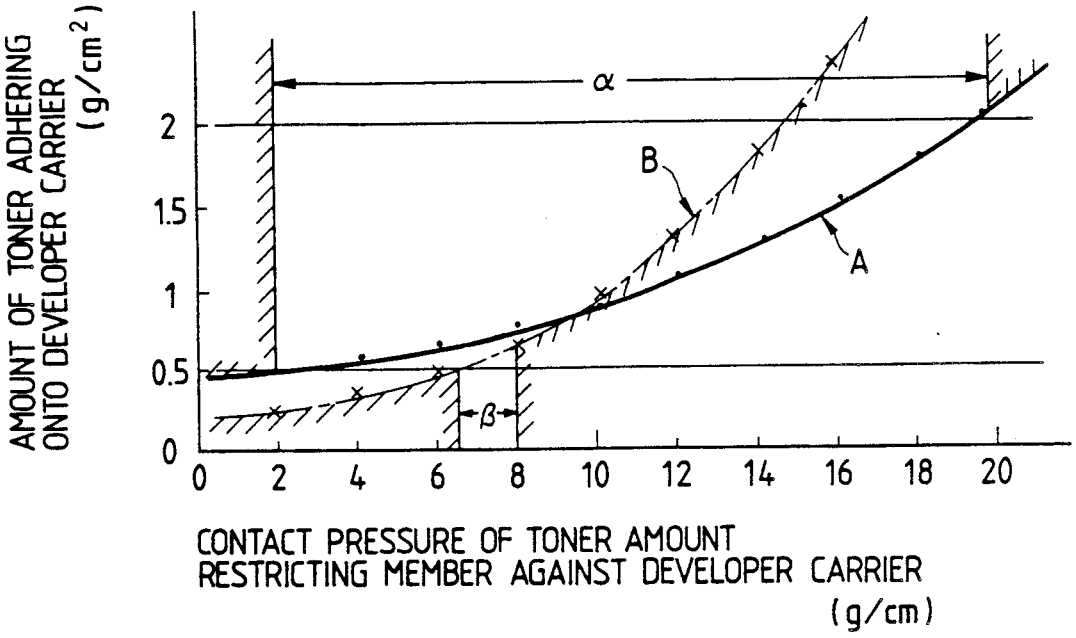
FIG. 8 is a diagram illustrating the relationship between the contact pressure of the toner amount restricting member to the developer carrier, and the amount of toner adhering onto the developer carrier according to a conventional micro-capsule toner developing apparatus and a developing apparatus according to the present invention.

Similar to FIG. 7, FIG. 8 is a diagram illustrating the relationship between the contact pressure of the toner amount restricting member against the developer carrier and the amount of adhering toner on the developer carrier. As is apparent from FIG. 8, it is possible to form a uniform and stable toner layer in the region $\alpha$ in the developing apparatus according to the present invention, while in the conventional developing apparatus shown in FIG. 10, on the contrary, it is possible to form a uniform and stable toner layer merely in the region $\beta$.

It has been confirmed that in the developing apparatus according to the present invention, even if the plate spring *7a* is formed of a material which is hardly plastic-deformed, (for example, stainless-steel) or even if the toner amount restricting member is in contact with the developer carrier with low pressure (≦20 g/cm) so as not to rupture the microcapsule toner, the forward end portion of the soft elastic member *7b* uniformly contacts the developer carrier 6 in the axial and circumferential directions thereof, so that it is possible to form a uniform and stable toner layer on the developer carrier 6.

Further, as shown in FIG. 3, even if the forward end portion of the soft elastic member *7b* of the toner amount restricting member 7 is arranged in the same direction as the rotation of the developer carrier 10, it is possible to maintain a uniform developer layer for a long time, and it is therefore possible to obtain a stable and high-quality copy since the developer layer is restricted by the surplus forward end portion, that is, the toner outflow portion, of the soft elastic member *7b*.

Comparative Embodiment

The toner amount restricting member 7 used was silicone rubber *7b* having a thickness of 1 mm provided at the forward end portion of a support *7a* constituted by a polyester film (trademark: "MYLAR", produced by Du Pont (E.I.) de Nemours & Co.) having a thickness of 100 $\mu$m. The contact pressure of the restricting member 7 against the developer carrier was set to 2 g/cm, the deflection angle thereof was set to 25°, and the length of the toner amount restricting member 7 from the contact portion between the toner amount restricting member 7 and the developer carrier 6 to the free end portion thereof was set to 0 mm.

The developer 4 was microcapsule particles which were prepared by interfacial polymerization so that the average particle diameter was 15 $\mu$m, and each particle was composed of polyisobutyl chlorate as its core material and polyurethane resin as its outer shell and contained 40% magnetite magnetic powder of residual magnetism 10.8 emu/g and 135 oersted. The developer 4 was put into the developing apparatus shown in FIG. 10 and a toner layer was obtained. At that time, the amount of toner adhering onto the developer carrier 6 was 0.6 mg/cm$^2$.

Thereafter, developing was performed under the AC electric field conditions that the frequency was 2.4 KHz, the peak-to-peak voltage was 2.4 KV, and the superimposed DC component was −200 V, and a good copy could be obtained. However, if the developing apparatus was used repeatedly for a long time, there occurred a problem that the plate spring *7a* of the toner amount restricting member 7 was deformed so that the contact pressure of the toner amount restricting member 7 in the axial and circumferential directions of the developer carrier 6 was not uniform, and it was difficult to obtain a toner layer of constantly uniform thickness.

Therefore, in the case where the plate spring *7a* of the toner amount restricting member 7 was constituted by a material which was hardly plastic-deformed, for example, stainless-steel (SUS304CSP3/4H), fine variations were caused in pressure distribution between the toner amount restricting member 7 and the developer carrier 6 to make the amount of toner formed on the developer carrier 6 uneven, and to make it impossible to form a uniform toner layer, even if the toner layer restricting factors (for example, mechanical machining accuracy such as linearity, parallelism, etc.) of the toner amount restricting member 7 relative to the developer carrier 6 were made more severe than in the initial state.

Embodiment 3

Figure 4:
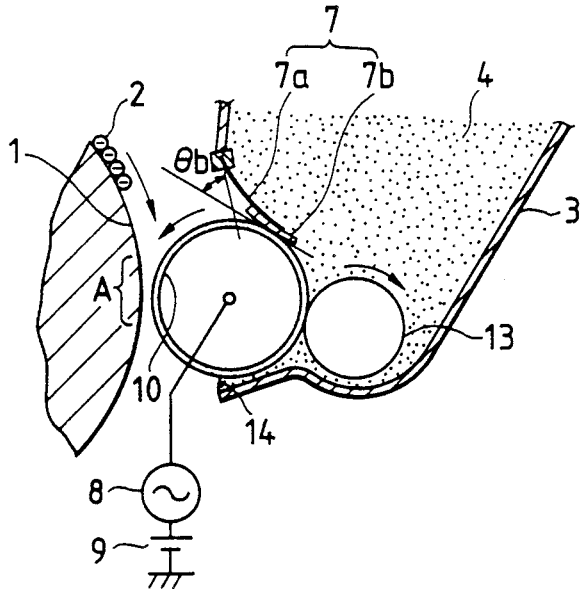
FIG. 4 is a schematic diagram of the non-magnetic one-component developing apparatus according to the present invention, showing the case where the deflection angle $\theta_b$ of the plate spring is negative when the toner amount restricting member is pressed into contact with the developer carrier.
Figure 5:
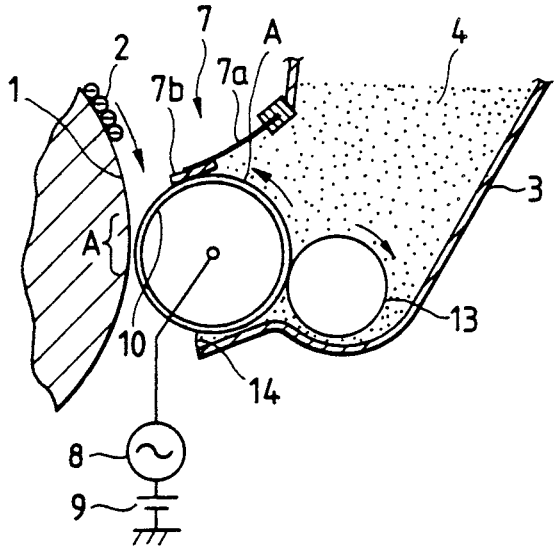
FIG. 5 is a schematic diagram of the non-magnetic one-component developing apparatus according to the present invention, showing the case where the deflection angle $\theta_b$ of the plate spring is positive.

FIG. 4 is a schematic diagram of the non-magnetic one-component developing apparatus according to the present invention, showing the case where the deflection angle $\theta_b$ of the plate spring is negative when the toner amount restricting member is pressed to contact the developer carrier, and FIG. 5 is a schematic diagram of the non-magnetic one-component developing apparatus according to the present invention, showing the case where the deflection angle $\theta_b$ of the plate spring is established to be positive.

In this non-magnetic one-component developing apparatus, the forward end portion of the soft elastic member *7b* projects out within a range from 0.1 to 10.0 mm from the end portion of the plate spring *7a*. Developing was performed in the same manner as the above-mentioned embodiments, and it was confirmed that there was an effect when the deflection angle of the toner amount restricting member 7 was within a range of $-20° \leqq \theta_b \leqq 90°$.

Figure 13:
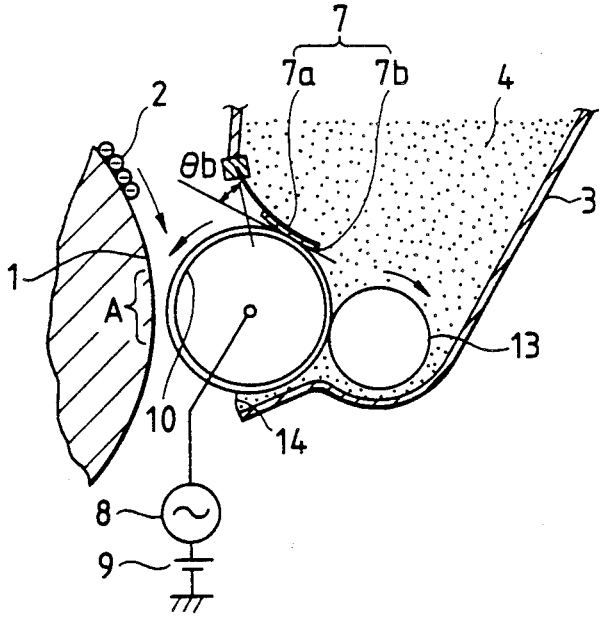
FIG. 13 PRIOR ART
FIG. 13 is a schematic diagram of a conventional non-magnetic one-component developing apparatus, showing the case where the deflection angle $\theta_b$ of the plate spring is negative when the toner amount restricting member is pressed to come into contact the developer carrier.
Figure 14:
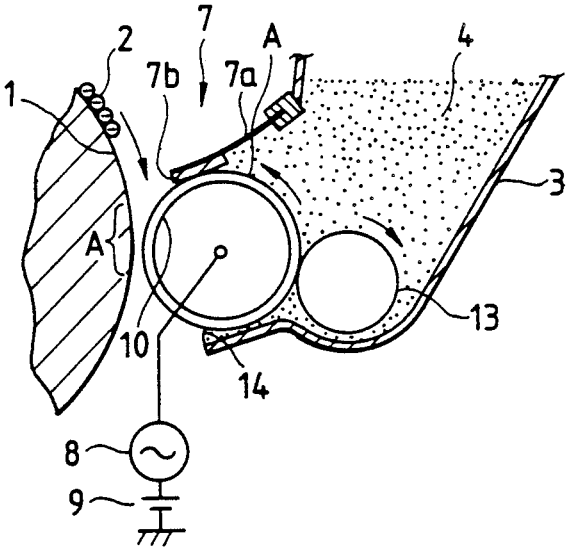
FIG. 14 PRIOR ART
FIG. 14 is a schematic diagram illustrating the developing apparatus of FIG. 13 in the case where the deflection angle $\theta_b$ of the plate spring is positive when the toner amount restricting member is pressed to come into contact with the developer carrier.

The effect of the developing apparatus according to the present invention will be described with reference to FIG. 9 in comparison with the conventional developing apparatus shown in FIG. 13.

Figure 9:
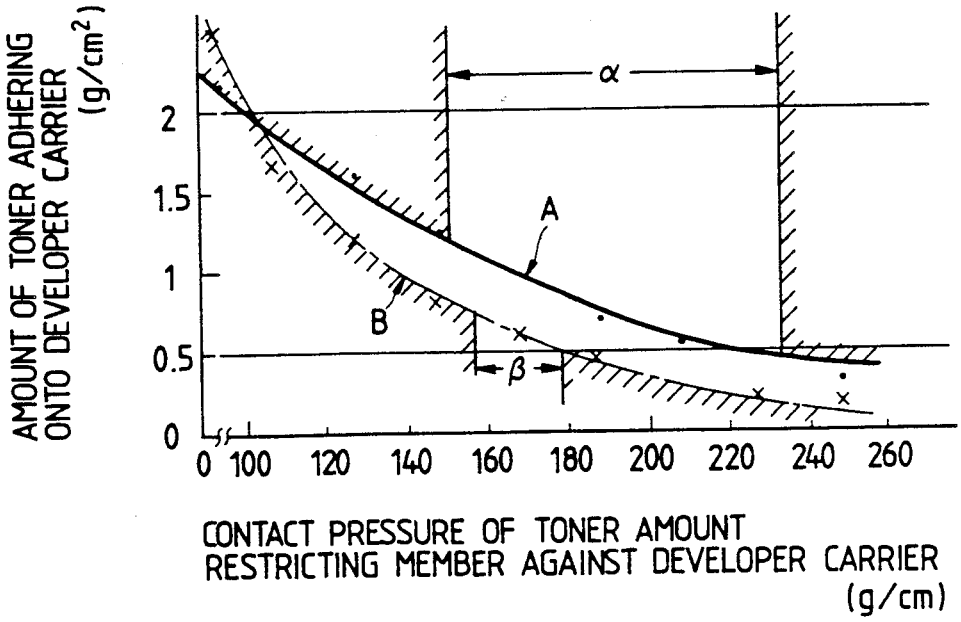
FIG. 9 is a diagram illustrating the relationship between the contact pressure of the toner amount restricting member to the developer carrier, and the amount of toner adhering onto the developer carrier according to a conventional non-magnetic one-component developing apparatus and a developing apparatus according to the present invention.

Similar to FIG. 7, FIG. 9 is a diagram illustrating the relationship between the contact pressure of the toner amount restricting member against the developer carrier and the amount of adhering toner on the developer carrier. As is apparent from FIG. 9, it is possible to form a uniform and stable toner layer in the region $\alpha$ in the developing apparatus according to the present invention, while in the conventional developing apparatus, on the contrary, it is possible to form a uniform and stable toner layer merely in the region $\beta$.

As shown in FIG. 5, even if the toner amount restricting member 7 is arranged in the same direction as the rotation of the developer carrier 10, it is possible to maintain a uniform developer layer for a long time, and it is therefore possible to obtain a stable and high-quality copy because the developer layer is restricted by the surplus forward end portion, that is, the toner outflow portion, of the soft elastic member *7b*.

Figure 6A:
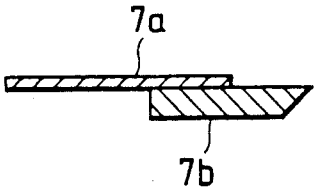
FIG. 6(*a*) and 6(*b*) are sectional views of another embodiment of the soft elastic member according to the present invention.
Figure 6B:
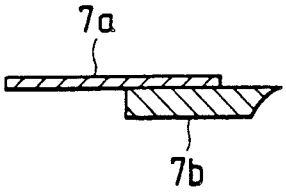

Moreover, even if the end side of the soft elastic member *7b* of the toner amount restricting member 7 in each of the above embodiments is tapered or spherical as shown in FIG. 6(*a*) or 6(*b*), the same effect can be obtained.

According to the present invention, the toner amount restricting member in contact with the developer carrier is constituted by a support constituted by a plate spring having tensile strength not smaller than 15 kgf/mm$^2$ and yield strength not smaller than 10 kgf/mm$^2$, and a soft elastic member provided at a portion where the toner amount restricting member contacts with the developer carrier. The soft elastic member is arranged to project out from the forward end portion of the support so that it is possible to reduce the contact pressure of the toner amount restricting member against the developer carrier at a large scale to 1/20 or less in comparison with that in the conventional case, and it is therefore possible to decrease the driving torque of the developer carrier at a large scale to 1/10 or less in comparison with that in conventional case.

Further, it is also possible to prevent a mechanical stress from being produced by the friction between the developer carrier and the toner amount restricting member, or prevent toner from being deteriorated by heating. Further, having soft elasticity, the forward end portion of the soft elastic member follows the displacement of the developer carrier in the axial and circumferential directions thereof, such as with a very slight swing of the developer carrier, a very small waviness of the toner amount restricting member, or the like, so that uniform contact pressure can be obtained and a toner layer can be always formed on the developer carrier stably, and developing can be performed with high reliability.

What is claimed is:

1. A one-component developing apparatus comprising:

a developer carrier disposed in opposition to an electrostatic latent image receiving member; and a toner amount restricting member pressed so as to be in contact with said developer carrier, wherein said toner amount restricting member includes a support member made of a plate spring having tensile strength not smaller than 15 kgf/mm$^2$ and yield strength not smaller than 10 kgf/mm$^2$, and a soft elastic member disposed on said support member at a portion thereof to be pressed into contact with said developer carrier, said soft elastic member being attached on said support member so as to project from a forward end of said support member, and whereby a layer of toner with improved uniformity is formed on said developer carrier by said toner amount restricting member and charged so that said layer of toner is made to adhere on an electrostatic latent image to make the electrostatic latent image visible.

2. A one-component developing apparatus according to claim 1, in which said soft elastic member is projected from the forward end of said support member with a projecting length within a range of from 0.1 to 10.0 mm.

3. A one component developing apparatus according to claim 1, in which a deflection angle $\theta_b$ of said plate spring, when said toner amount restricting member is in contact with said developer carrier, is set to a value within a range of $-20° \leqq \theta_b \leqq 90°$.

4. A one-component developing apparatus according to claim 2 wherein said soft elastic member is projected from the forward end of said support member with a projecting length of 0.5 to 8.0 mm.

5. A one-component developing apparatus according to claim 4 wherein said soft elastic member is projected from the forward end of said support member with a projecting length of 2.0 mm.

6. A one-component developing apparatus according to claim 1 wherein said soft elastic member has a hardness ranging from 30° to 70°.

7. A one-component developing apparatus according to claim 6 wherein said soft elastic member has a surface energy of not larger than 30 dyn./cm.

8. A one-component developing apparatus of claim 1 wherein said soft elastic member is made of silicone rubber has a thickness of 1 to 6 mm.

9. A one-component developing apparatus according to claim 1 wherein said plate spring is made of non-magnetic stainless steel with thickness ranging from 0.08 to 0.2 mm.

* * * * *

UNITED STATES PATENT AND TRADEMARK OFFICE

CERTIFICATE OF CORRECTION

PATENT NO. : 4,990,959

DATED : February 05, 1991

INVENTOR(S) : Takashi Yamamuro et al.

It is certified that error appears in the above-identified patent and that said Letters Patent is hereby corrected as shown below:

Claim 8, column 12, line 11, "has" should read --having--.

Abstract, line 6, "nade" should read --made--; line 16-17, "made adhere" should read --made to adhere--.

Signed and Sealed this

Second Day of March, 1993

*Attest:*

STEPHEN G. KUNIN

*Attesting Officer*

*Acting Commissioner of Patents and Trademarks*